United States Patent [19]

Garavuso

[11] 4,359,219

[45] Nov. 16, 1982

[54] DIRECT CONTROL PADDLE WHEEL

[75] Inventor: Gerald M. Garavuso, Farmington, N.Y.

[73] Assignee: Xerox Corporation, Stamford, Conn.

[21] Appl. No.: 174,774

[22] Filed: Aug. 4, 1980

[51] Int. Cl.[3] ..... B65H 9/10; B65H 9/16

[52] U.S. Cl. ..... 271/236; 271/120; 271/225; 271/264; 271/251; 414/36

[58] Field of Search ..... 271/251, 250, 236, 238, 271/248, 120, 119, 314, 264, 184, 225; 355/75, 76, 35 H, 14 SH; 198/345, 434, 457, 456; 414/36

[56] References Cited

U.S. PATENT DOCUMENTS

| | | | |
|---|---|---|---|
| 311,340 | 1/1885 | Loffelhardt | 271/119 UX |
| 3,321,078 | 5/1967 | Treiber . | |
| 3,630,516 | 12/1971 | Hong | 271/120 X |
| 3,669,447 | 6/1972 | Turner et al. | 271/120 X |
| 3,980,296 | 9/1976 | Craft et al. | 271/251 |
| 4,017,066 | 4/1977 | Lasher et al. | 271/251 X |
| 4,029,309 | 6/1977 | Lynch et al. | 270/53 |
| 4,084,807 | 4/1978 | Terajima et al. | 271/119 |
| 4,126,305 | 11/1978 | Colglazier et al. | 271/120 |
| 4,165,870 | 8/1979 | Fallow et al. | 271/250 X |

OTHER PUBLICATIONS

Hurricks, P. "Rapid Top Sheet Registration Device", *Xerox Disclosure Journal,* vol. 4, No. 6, Nov./Dec. 1979, pp. 749–750.

Hawkins, David N. et al. "Paddle Wheel Platen Transport", *Xerox Disclosure Journal,* vol. 4, No. 3, May/Jun. 1979, p. 327.

*Primary Examiner*—Bruce H. Stoner, Jr.

*Attorney, Agent, or Firm*—William A. Henry, II

[57] ABSTRACT

A direct control paddle wheel apparatus for document corner registration includes a paddle wheel with multiple blades that drive a document into registration with intersecting walls. The blades, as they rotate, are channeled in a direction plate or in the alternative along the surface of an interference barrier and, as a consequence, drive a document from side to side, as well as straight ahead depending on the shape of the plate or barrier.

9 Claims, 2 Drawing Figures

DIRECT CONTROL PADDLE WHEEL

This invention relates to an electrophotographic printing machine and more particularly to a direct control paddle wheel registration system.

Modern advancement in high speed copying machines lead to early recognition that machine operators could not perform their normal functions at a speed commensurate with the speed of the copying machine, resulting in copy output from the machines much lower than the printing speed of the machine. To minimize operator involvement and allow maximum output from the printing machine, automatic features were needed.

It is in answer to this need that the automatic direct control paddle wheel corner registration system of the present invention is provided. Registration systems in the past have employed rollers to align first a front edge and subsequently the rear edge of a document as disclosed in U.S. Pat. No. 3,980,296, issued Sept. 14, 1976, to James Alexander Craft et al. Another registration system is shown in U.S. Pat. No. 4,029,309, issued June 14, 1977, to Thomas Lynch et al. This registration system discloses the use of two orthogonal, out-of-phase, synchronized single paddle wheels for corner registration.

As an improvement over corner registration systems as represented in U.S. Pat. No. 4,029,309, in one aspect, the present invention provides a document registration system for a copier that includes a single paddle wheel having multiple paddles that are driven along an interference barrier. By using cylindrical blades, flexibility will be uniform in all directions radial to a particular blade. Consequently, interference barriers are used to deflect the blades from side to side, as well as limit the length of the sweep depending on the shape of the barrier.

In another aspect, a direct control paddle wheel apparatus for corner registration is disclosed that includes a paddle wheel with multiple blades that drive a document into registration with intersecting walls. The blades are rotated by the paddle wheel through a direction channel located within a direction plate. Due to the shape of the channel, the direction and magnitude of substrate movement is controlled.

Other features of the present invention will become apparent as the following description proceeds and upon reference to the drawings in which.

While the present invention will be described hereinafter in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
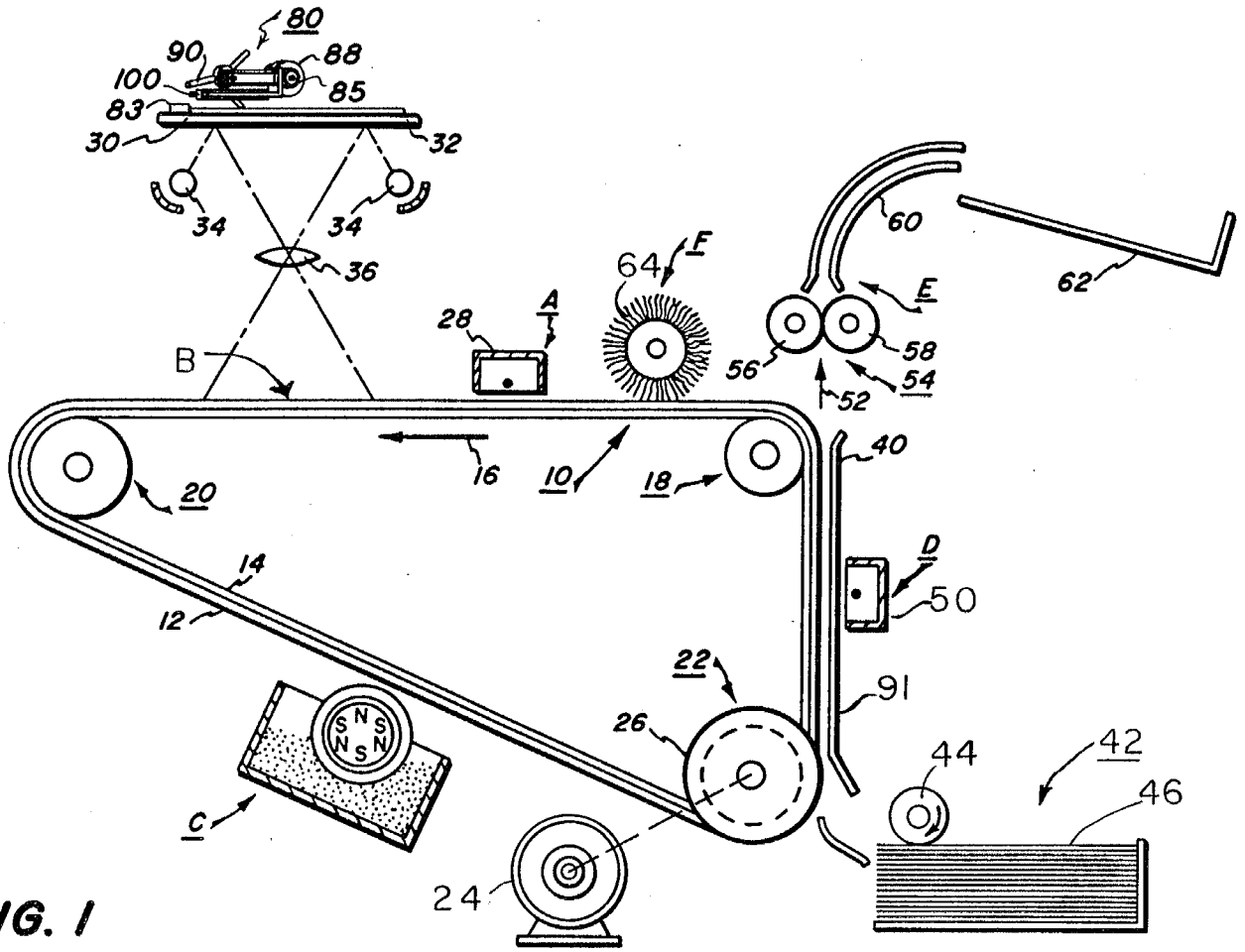
FIG. 1 is a schematic elevational view of an electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the document corner registration apparatus of the present invention therein. It will become evident from the following discussion that the registration system is equally well suited for use in a wide variety of devices and is not necessarily limited to its application to the particular embodiment shown herein. For example, the apparatus of the present invention may be adapted for use in compilers or readily employed in non-xerographic environments and substrate registration in general.

Inasmuch as the art of electrophotographic printing is well known, the various proceeding stations employed in the FIG. 1 printing machine will be shown hereinafter schematically and the operation described briefly with reference thereto.

As shown in FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from nickel. Belt 10 moves in the direction of arrow 16 to advance successive portions of photoconductive surface 12 sequentially through the various processing stations disposed about the path of movement thereof. Belt 10 is entrained around stripper roller 18, tension roller 20, and drive roller 22.

Drive roller 22 is mounted rotatably in engagement with belt 10. Motor 24 rotates roller 22 to advance belt 10 in the direction of arrow 16. Roller 22 is coupled to motor 24 with a suitable means such as a belt drive. Drive roller 22 includes a pair of opposed spaced flanges or edge guides 26. Edge guides 26 are mounted on opposite ends of drive roller 22 defining its space therebetween which determines the desired predetermined path of movement for belt 10. Edge guide 26 extends in an upwardly direction from the surface of roller 22. Preferably edge guides 26 are circular members or flanges.

Belt 10 is maintained in tension by a pair of springs (not shown), resiliently urging tension roller 20 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 28, charges photoconductor 12 of the belt 10 to a relatively high, substantially uniform potential. A suitable corona generating device is described in U.S. Pat. No. 2,836,725, issued to Vyverberg in 1958.

Next, the charged portion of photoconductive surface 12 is advanced through exposure station B. At exposure station B, an original document 30 is positioned face down upon transparent platen 32. Lamps 34 flash light rays onto original document 30. The light rays reflected from the original document 30 are transmitted through lens 36 from a light image thereof. The light image is projected onto the charged portion of the photoconductive surface 12 to selectively dissipate the charge thereon. This records an electrostatic latent image on photoconductive surface 12 which corresponds to the informational areas contained within original document 30.

Thereafter, belt 10 advances the electrostatic latent image recorded on photoconductive surface 12 to development station C. At development station C, a magnetic brush developer roller 38 advances a developer mix into contact with the electrostatic latent image. The latent image attracts the toner particles from the carrier granules forming a toner powder image on photoconductive surface 12 of belt 10.

Belt 10 then advances the toner powder image to transfer station D. At transfer station D, a sheet of support material 46 is moved into contact with the toner powder image. The sheet of support material is advanced to transfer station D by a sheet feeding apparatus 42. Preferably, sheet feeding apparatus 42 includes a feed roll 44 contacting the upper sheet 46 of the stack. Feed roll 44 rotates so as to advance the uppermost sheet from the stack into transport 91. The transport directs the advancing sheet of support material into contact with the photoconductive surface 12 of belt 10 in a timed sequence so that the toner powder image developed thereon contacts the advancing sheet of support material at transfer station D.

Transfer station D includes a corona generating device 50 which emits ions onto the backside of sheet 46. This attracts the toner powder image from the photoconductive surface 12 to sheet 46. After transfer, the sheet continues to move in the direction of arrow 52 onto a conveyor (not shown) which advances the sheet to fusing station E.

Fusing station E includes a fuser assembly, indicated generally by the reference number 54, which permanently affixes the transferred toner powder image to sheet 46. Preferably, fuser assembly 54 includes a heated fuser roller 56 and a backup roller 58. Sheet 46 passes between fuser roller 56 and backup roller 58 with the toner powder image contacting fuser roller 56. In this manner, the toner powder image is permanently affixed to sheet 46. After fusing, chute 60 guides the advancing sheet 46 to catch tray 62 for removal from the printing machine by the operator.

Invariably, after the sheet support material is separated from the photoconductive surface 12 of belt 10, some residual particles remain adhering thereto. These residual particles are removed from photoconductive surface 12 at cleaning station F. Cleaning station F includes a rotatably mounted fiberous brush 64 in contact with the photoconductive surface 12. The particles are cleaned from photoconductive surface 12 by the rotation of brush 64 in contact therewith. Subsequent to cleaning, a discharge lamp (not shown) floods photoconductive surface 12 with light to dissipate any residual electrostatic charge remaining thereon prior to the charging thereof for the next successive image cycle.

It is believed that the foregoing description is sufficient for purposes of the present application to illustrate the general operation of an electrostatographic printing machine.

Referring now to the specific subject matter of the present invention, FIG. 1 shows a direct control paddle wheel system 80 for corner registration that employs a paddle wheel 81 which has multiple cylindrical blades 90 thereon. While the paddle wheel of the invention is disclosed with multiple blades, it should be understood that a one bladed paddle wheel will function to corner register sheets also. The present invention is not limited to side or corner registration and can be used for driving substrates sideways or in a straight line simply by shaping, in any desired manner, a channel located within a direction plate through which the paddles must pass or by shaping an interference barrier along which the blades travel. This device enables effective registration from a wide range of substrate input positions and orientations by supplying two or more driving forces at large angles to each other.

Figure 2:
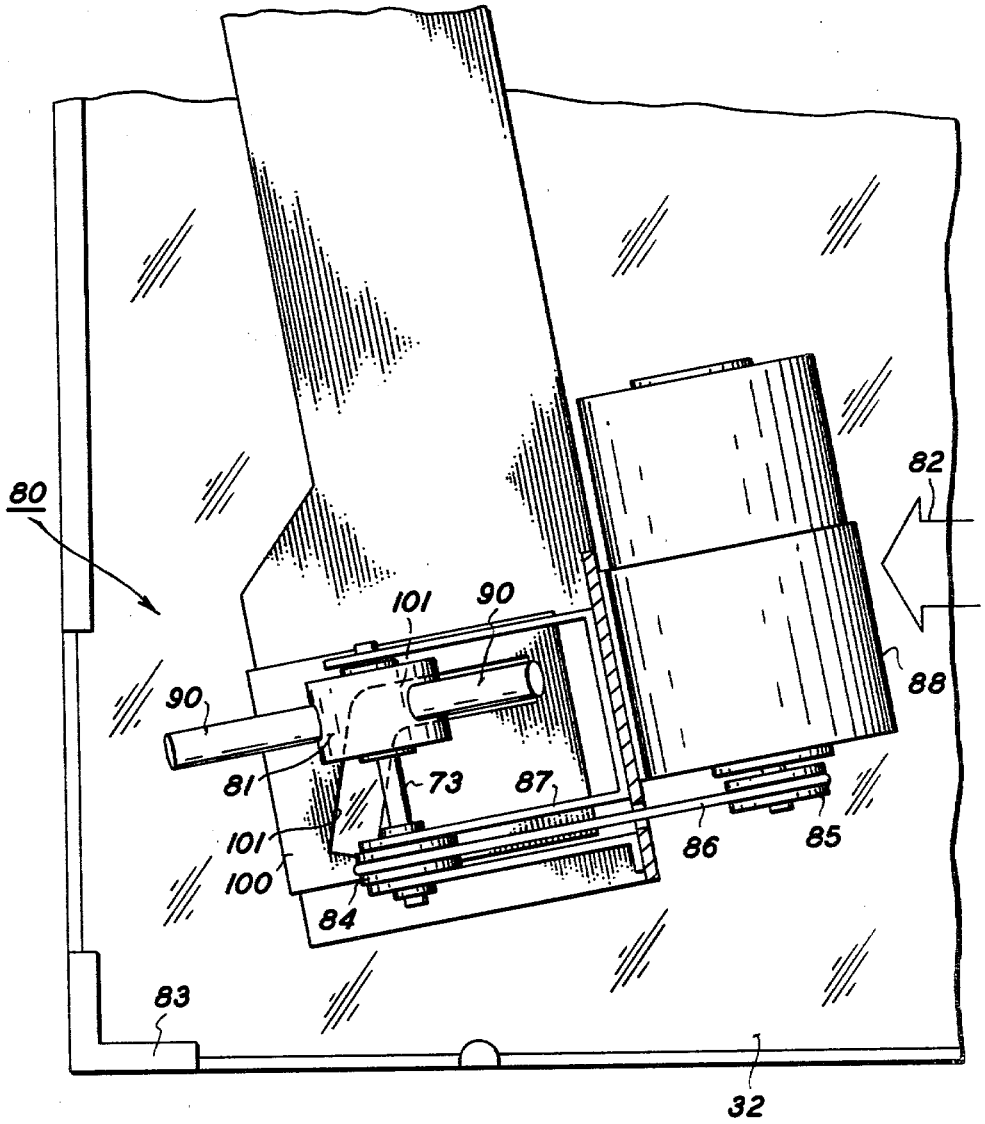
FIG. 2 is a plan view of the present invention.

More specifically, as shown in FIG. 2, in order to achieve registration of documents or substrates with a wide range of skew angles and a side edge location when entering document handler 80, a single paddle wheel with blades that are rotated through a directional plate or along an interference barrier is provided.

In operation, documents 30 that are placed onto platen 32 in the direction of arrow 82 are met by paddle wheel 81. Projecting from paddle wheel 81 are blades 90. The blades are cylindrical in shape and are made of urethane or other flexible, frictional material. By using a paddle wheel 81 with cylindrical blades, their flexibility will be uniform in all directions radial to that blade being flexed. Paddle wheel 81 is mounted on shaft 73 which is supported by bracket 87. Rotation of paddle wheel 81 is obtained by actuation of drive motor 88 by any suitable means, such as, a switch triggered by the document. The motor 88 in turn drives pulley 85 which is drivingly connected to pulley 84 through belt 86. The driving of pulley 84 turns shaft 73 on which is mounted paddle wheel 81. As the paddle wheel rotates, blades 90 encounter direction plate 100 which has a cut-out channel portion 101 located therein. The channel directs the paddles in changing their direction as they navigate the channel and the paddles, in turn, direct as well as drive the document 30 into corner 83 and registers it. Corner 83, as shown in FIG. 2, defines a pair of intersecting registration walls. By changing the magnitude and orientation of the channel through which the blades are forced, a wide range of force directions and durations can be obtained. As an alternative, an interference barrier, for example, in the shape of a triangle, could replace direction plate 100 in the rotational path of paddle wheel 81. As the wheel rotates, paddles 90 travel along one side to the apex of the triangle barrier. Continued rotation of the paddle wheel propels the blades down the opposite side of the barrier due to their flexibility, all the while directing and driving document 30 according to the shape of the barrier. The barrier could be any shape that gives the desired drive direction to the paddles. Also, the direction plates or barrier are used for both vertical, as well as horizontal, direction control of substrates.

In conclusion, an improved corner registration system is disclosed for driving, as well as controlling, the direction of substrates that includes a paddle wheel having cylindrical blades. The blades, as they are rotated by the paddle wheel, are propelled into a channel located in a direction plate. The shape of the channel dictates the direction in which the blades will forward the substrates, as well as the sweep length and thereby propelling force of the blades. By using cylindrical blades, their flexibility will be uniform in all directions radial thereto. As a result, direction plates are employable to deflect blades from side to side or limit their sweep length. An interference barrier could replace the direction plate and perform with positive results.

This apparatus fully satisfies the aims and advantages hereinbefore set forth. While this invention has been described in conjunction with specific embodiments thereof, it is evident that many alternatives, modifications, and variations will be apparent to those skilled in the art. Accordingly, it is intended to embrace all such alternatives, modifications and variations as fall within the spirit and scope of the appended claims.

What is claimed is:

1. An apparatus for controlling the direction of movement of substrates comprising:

paddle wheel means for driving a substrate, said paddle wheel means having at least one blade attached thereto and in driving relationship with a substrate;

force producing means for rotating said paddle wheel means and thereby moving said blade in a first direction of travel to drive the substrate therewith;

direction control means located in the path of said first direction of travel such that at a point of rotation of said paddle wheel means said blade is deflected from said first direction of travel into a second direction of travel, whereby substrates being driven in said first direction of travel are driven in said second direction of travel.

2. The control system according to claim 1 wherein said direction control means comprises a plate having a channel therein.

3. The control system according to claim 1 wherein said control means comprises an interference barrier.

4. The control system according to claims 2 or 3 wherein said blade of said paddle wheel means is cylindrical.

5. The control system according to claim 1 wherein said direction control means controls the drive force produced by said paddle wheel means by controlling the sweep length of said blade.

6. The substrate control system according to claim 1 wherein said paddle wheel means has multiple blades.

7. In a copier having a platen for exposing documents thereon, the improvement of a direct control paddle wheel document registration system, comprising:

corner means formed adjacent an area of said platen, said corner means including intersecting registration walls;

paddle wheel means adapted for driving a document on said platen in a first direction, said paddle wheel means having multiple blades attached thereto;

force producing means for rotating said paddle wheel means and thereby moving said blades in said direction of travel; and direction control means located within said first direction of travel such that at a point of movement of said paddle wheel said blades are deflected from said first direction of travel into a second direction of travel, whereby the document driven in said first direction by said paddle wheel is driven in said second direction of travel once said blades are deflected, said second direction of travel being arranged to deflect the document in said corner means in corner registration therewith.

8. The improvement according to claim 7 wherein said direction control means comprises a plate having a channel therein through which said blades are rotated.

9. The improvement according to claim 7 wherein said direction control means comprises an interference barrier.

* * * * *